US005129745A

United States Patent [19]

Bowers et al.

[11] Patent Number: 5,129,745

[45] Date of Patent: Jul. 14, 1992

[54] COMPUTER PRINTER RIBBON CARTRIDGE FOR MULTI-HEAD PRINTERS

[75] Inventors: George W. Bowers, Liberty Lake; Michael E. Demarchi, Spokane, both of Wash.

[73] Assignee: Output Technology Corporation, Spokane, Wash.

[21] Appl. No.: 718,629

[22] Filed: Jun. 21, 1991

[51] Int. Cl.[5] ..... B41J 35/28; B41J 33/32

[52] U.S. Cl. ..... 400/208; 400/241; 400/248; 400/82

[58] Field of Search ..... 400/208, 247, 248, 248.1, 400/208, 241, 194, 196, 196.1, 82

[56] References Cited

U.S. PATENT DOCUMENTS

| | | | |
|---|---|---|---|
| 835,722 | 11/1906 | Anderson . | |
| 1,591,243 | 7/1926 | Smith . | |
| 2,518,893 | 8/1950 | Huether . | |
| 2,788,111 | 4/1957 | Spiegel . | |
| 2,895,586 | 7/1959 | Di Luco . | |
| 3,047,121 | 7/1962 | Roggenstein . | |
| 4,285,604 | 8/1981 | Rex | 400/247 |
| 4,403,874 | 9/1983 | Payne et al. | 400/206 |
| 4,483,633 | 11/1984 | Kosner, Jr. et al. | 400/196.1 |
| 4,504,160 | 3/1985 | Payne et al. | 400/196 |
| 4,576,490 | 3/1986 | Isobe | 400/82 |
| 4,786,195 | 11/1988 | Hibino et al. | 400/208 |
| 4,806,948 | 2/1989 | Bangs et al. | 346/76 |

FOREIGN PATENT DOCUMENTS

| | | | |
|---|---|---|---|
| 0224572 | 11/1985 | Japan | 400/82 |
| 0188176 | 8/1986 | Japan | 400/82 |
| 0248776 | 11/1986 | Japan | 400/82 |
| 488569 | 4/1970 | Switzerland . | |

*Primary Examiner*—Eugene H. Eickholt

*Attorney, Agent, or Firm*—Wells, St. John & Roberts

[57] ABSTRACT

The present invention relates to a computer printer ribbon cartridge for a printer having multiple print heads positioned at preset spaced distances on a reciporcating print head carriage. The printer ribbon cartridge (50) has a cartridge housing (52) for mounting on the print head carriage. A print ribbon (54) is mounted in the cartridge housing (52) and has an exposed print section which extends in front of the multiple print heads (102*a*, 102*b*, 102*c*). Multiple ribbon guides (62*a*, 62*b*, 62*c*) are slidably coupled on the exposed print section of the print ribbon (54) and, when coupled to the print heads, the ribbon guides guide the print ribbon over the printing face of the print heads. The printer ribbon cartridge further includes a ribbon guide carrier (70) which is releasably connected to the ribbon guides (62*a*, 62*b*, 62*c*) for supporting the ribbon guides on the exposed print section of the print ribbon at prescribed distances corresponding to the preset spaced distances of the multiple print heads (102*a*, 102*b*, 102*c*) on the print head carriage. The ribbon guide carrier (70) facilitates easy installation of the printer ribbon cartridge because all of the ribbon guides may be mounted simultaneously on the respective print heads.

23 Claims, 8 Drawing Sheets

COMPUTER PRINTER RIBBON CARTRIDGE FOR MULTI-HEAD PRINTERS

TECHNICAL FIELD

This invention relates to multi-head computer printers, and more particularly, to replaceable computer printer ribbon cartridges for multi-head printers.

BACKGROUND OF THE INVENTION

Computer printers commonly employ a single print head positioned on a reciprocating print head carriage. The single print head is moved across the entire recording medium during the printing process. For example, dot matrix printers employ a single print head with a plurality of individual printing elements arranged in an array extending across a rectilinear path of the print head relative to a recording medium. During the printing process, different combinations of these printing elements are activated as the print head is moved across the recording medium to produce desired alphanumeric characters, or the like, on the recording medium.

Printers may, however, employ multiple print heads which move in a coordinated manner across the recording medium. For discussion purposes, a multi-head dot matrix printer 10 is shown in FIG. 1. The multi-head dot matrix printer 10 has three print heads 12*a*, 12*b*, and 12*c* positioned at preset distances on a reciprocating print head carriage. The printing elements contained in the print heads 12*a*, 12*b*, and 12*c* face a platen 14. When the recording medium, such as paper, is loaded into the dot matrix printer 10, the paper travels between the print heads 12*a*, 12*b*, and 12*c* and the platen 14. The print heads 12*a*, 12*b*, and 12*c* traverse the paper in a reciprocating pattern in a direction perpendicular to the direction of travel of the paper.

A conventional ribbon cartridge for use in a printer having multiple print heads is shown in both FIGS. 1 and 2. The conventional printer ribbon cartridge 16 has a cartridge housing 20 which houses and protects a continuous print ribbon 18. The cartridge housing 20 includes a housing body 21 and two guide arms 22 and 24. The housing body 21 stores the bulk of the print ribbon 18. The two guide arms 22 and 24 extend substantially perpendicular from the housing body 21 to support and guide the print ribbon 18 from the housing body 21 and around the printing elements of the print heads 12*a*, 12*b*, and 12*c*. The printer ribbon cartridge 16 also has multiple ribbon guides 26*a*, 26*b*, and 26*c*, which guide the print ribbon 18 between the respective printing elements of print heads 12*a*, 12*b*, and 12*c* and the platen 14. The ribbon guides 26*a*, 26*b*, and 26*c* are slidably mounted to the print ribbon 18 so that the ribbon guides 26*a*, 26*b*, and 26*c* may easily slide along the print ribbon 18 as the print heads 12*a*, 12*b*, and 12*c* are moved back and forth across the recording medium.

To install the conventional multi-head printer ribbon cartridge 16, a user first mounts the housing 16 on the print head carriage. The exposed print section of the print ribbon 18 has some slack and thus lies loosely near the print heads 12*a*, 12*b*, and 12*c*. The user then separately mounts each of the ribbon guides 26*a*, 26*b*, and 26*c* onto respective printing heads 12*a*, 12*b*, and 12*c*. As illustrated in FIG. 3, this step requires the user to grasp each ribbon guide 26*a* and slide the ribbon guide 26*a* onto the print head 12*a*. As a final step, the user tightens the print ribbon 18 to remove any excess slack and to ensure that the print ribbon 18 is properly positioned over the printing elements of the print heads 12*a*, 12*b*, and 12*c*.

The conventional printer ribbon cartridge 16 has two major disadvantages. First, installation of the conventional printer ribbon cartridge is very cumbersome. Each of the ribbon guides 26*a*, 26*b*, and 26*c* slide and twist relative to, and independently of, the other ribbon guides. As a result, the user must individually mount each of the ribbon guides 26*a*, 26*b*, and 26*c* on the respective print heads 12*a*, 12*b*, and 12*c*. Second, installation is very messy. Because the user must handle each of the ribbon guides 26*a*, 26*b*, and 26*c* individually, the user's fingers are in close proximity with the print ribbon 18 as shown in FIG. 3. As a result, the user normally cannot avoid handling the messy and ink soaked print ribbon 18.

The present invention overcomes the cited disadvantages of the conventional printer ribbon cartridges. First, the present invention facilitates easy installation. The user may simultaneously mount all of the ribbon guides onto the respective print heads. Second, the present invention reduces the installation mess because the user handles only the ribbon guide carrier, rather than each individual ribbon guide.

These and other advantages of the present invention will become apparent upon reading and understanding the following detailed description of a preferred embodiment.

BRIEF DESCRIPTION OF THE DRAWINGS

One or more preferred embodiments of the invention are illustrated in the accompanying drawings, which are briefly described below.

FIGS. 5–7 illustrate the method of installing the printer ribbon cartridge according to the present invention;

DETAILED DESCRIPTION OF THE PREFERRED EMBODIMENTS

This disclosure of the invention is submitted in furtherance of the constitutional purposes of the Patent Laws "to promote the progress of science and useful arts" (Article 1, Section 8).

Figure 4:
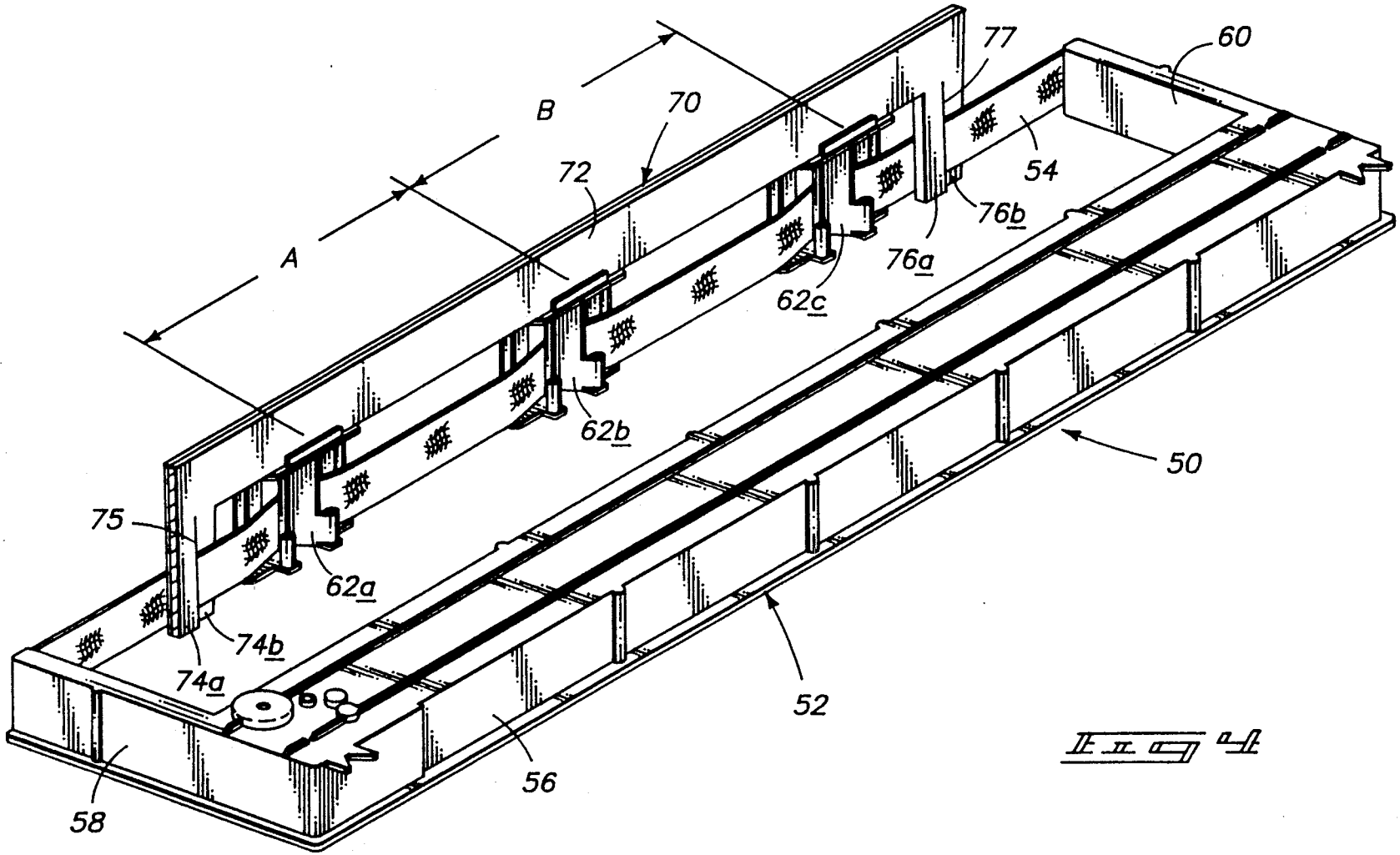
FIG. 4 is a perspective view of a preferred embodiment of a printer ribbon cartridge according to the present invention.

FIG. 4 shows a multi-head computer printer ribbon cartridge 50 according to the present invention for use in a multi-head printer. The printer ribbon cartridge 50 has a cartridge housing 52 which houses and protects the print ribbon 54. The cartridge housing 52 includes a housing body 56 and two guide arms 58 and 60. The two guide arms 58 and 60 extend substantially perpendicular from the housing body 56 to support and guide the print ribbon 54 from the housing body 56 and around the print heads (not shown).

The cartridge housing 52 contains the bulk of the print ribbon 54, but a small print section of the print ribbon 54 is exposed between the two guide arms 58 and 60. The exposed print section of the print ribbon 54 extends in front of the printing elements of the print heads.

The printer ribbon cartridge 50 also includes three ribbon guides 62*a*, 62*b*, and 62*c* which are slidably coupled to the exposed print section of the print ribbon 54. The ribbon guides 62*a*, 62*b*, and 62*c* are mounted on the print heads of a printer, as will be discussed below in more detail. The number of ribbon guides 62*a*, 62*b*, and 62*c* employed on the printer ribbon cartridge 50 corresponds to the number of print heads of the multi-head printer. Accordingly, although three ribbon guides 62*a*, 62*b*, and 62*c* are shown in FIG. 4, the present invention contemplates a printer ribbon cartridge having two, three, four, or more ribbon guides.

Figure 1:
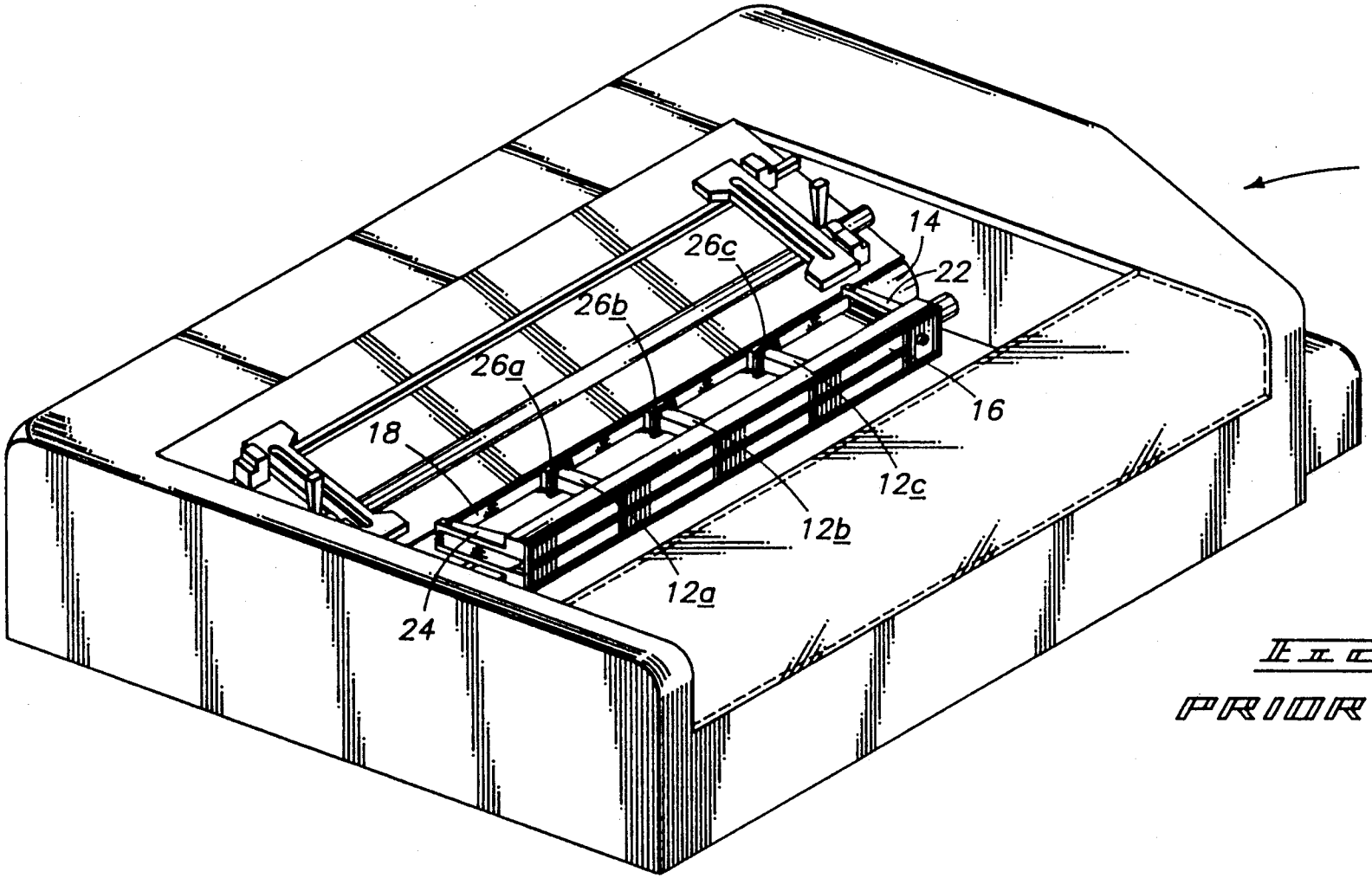
FIG. 1 PRIOR ART
FIG. 1 is a perspective view of a conventional multi-head dot matrix printer having a conventional printer ribbon cartridge.
Figure 2:
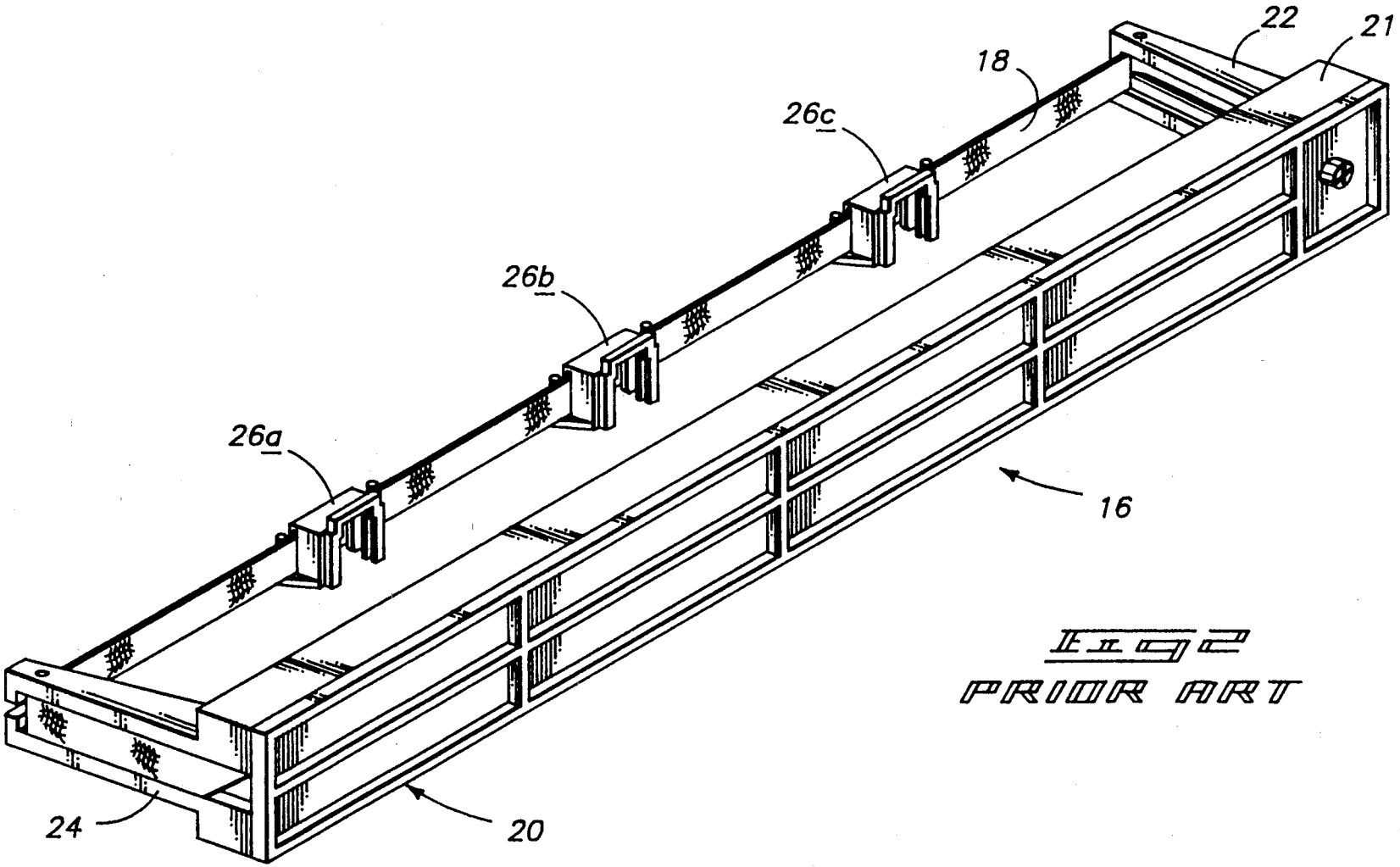
FIG. 2 PRIOR ART
FIG. 2 is an enlarged perspective view of the conventional printer ribbon cartridge illustrated in FIG. 1.
Figure 3:
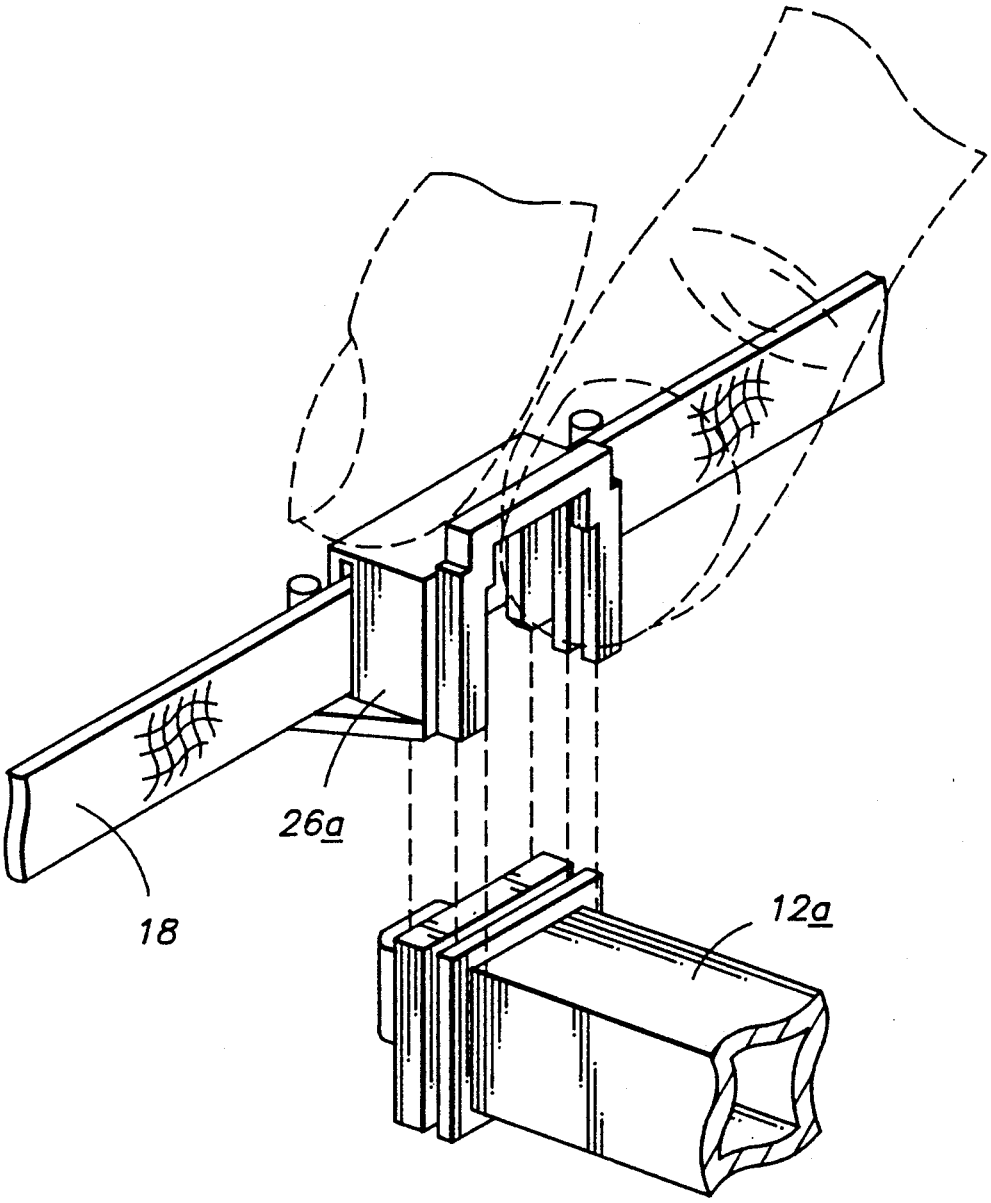
FIG 3 PRIOR ART
FIG. 3 illustrates the mounting of a ribbon guide of the conventional printer ribbon cartridge on to a print head.

The printer ribbon cartridge 50 further includes a releasable ribbon guide carrier 70 which is operatively connected to the ribbon guides 62*a*, 62*b*, and 62*c*. The ribbon guide carrier 70 supports the ribbon guides 62*a*, 62*b*, and 62*c* on the exposed print section of the print ribbon 54 at prescribed distances A and B. The distances A and B are approximately equal to the preset spaced distances among the print heads of the multi-head printer (for example, the spacing distances among the print heads 12*a*, 12*b*, and 12*c* of the dot matrix printer 10 in FIG. 1). The distance A is preferably, but not necessarily, equal to the distance B.

The ribbon guide carrier 70 is preferably formed of plastic, but may be formed of other materials, such as, for example, waxed cardboard.

Figure 8A:
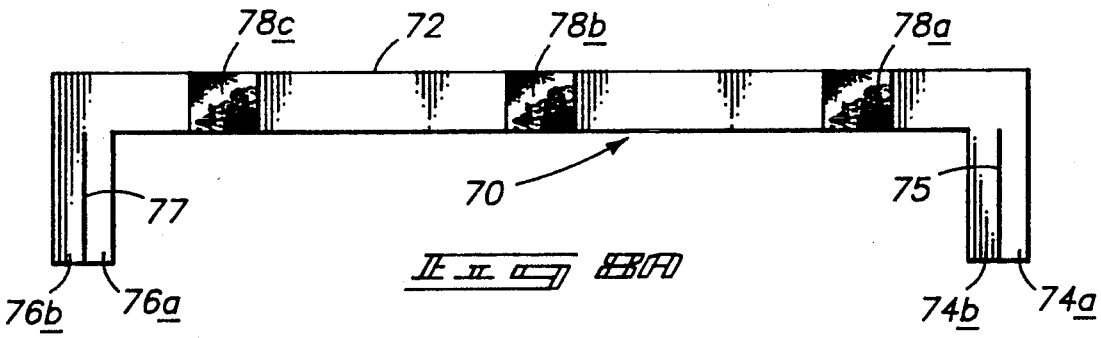
FIGS. 8A and 8B are back elevation views (relative to the perspective view shown in FIG. 4) of two embodiments of a ribbon guide carrier according to the present invention.

The ribbon guide carrier 70 has a body 72, three attachment regions arranged on the back of the body 72, and two sets of members 74*a*, 74*b* and 76*a*, 76*b*. The attachment regions are not depicted in the perspective view shown in FIG. 4, but are shown in FIG. 8A which depicts the back side of the ribbon guide carrier 70. As shown in FIG. 8A, the three attachment regions 78*a*, 78*b*, and 78*c* are rectangular areas positioned on the body 72 at prescribed distances to support the ribbon guides 62*a*, 62*b*, and 62*c* at the preset spaced distances of the print heads of the multi-head printer. The attachment regions 78*a*, 78*b*, and 78*c* may be formed of double-sided tape, glue, or any other adhesive material. Moreover, although the preferred embodiment is described using the term "attachment regions", the present invention contemplates other means for releasably supporting the ribbon guides 62*a*, 62*b*, and 62*c*, so long as the means adequately supports the ribbon guides 62*a*, 62*b*, and 62*c* while the guides are being mounted onto the print heads, and then permits the release of the ribbon guides 62*a*, 62*b*, and 62*c* from the ribbon guide carrier 70 once the ribbon guides are properly mounted.

For example, in one embodiment, the ribbon guide carrier may be operatively connected to the ribbon guides via a mechanical, non-adhesive, design. In another embodiment, the ribbon guide carrier and ribbon guides may be formed as an integral piece of plastic whereby the ribbon guides are attached to the ribbon guide carrier via detachable joints. After the ribbon guides are mounted onto the print heads, the ribbon guide carrier is detached therefrom by breaking the joints. Therefore, the present invention is not limited to the descriptive term "attachment regions", which is merely employed herein to describe the preferred embodiment.

Figure 8B:
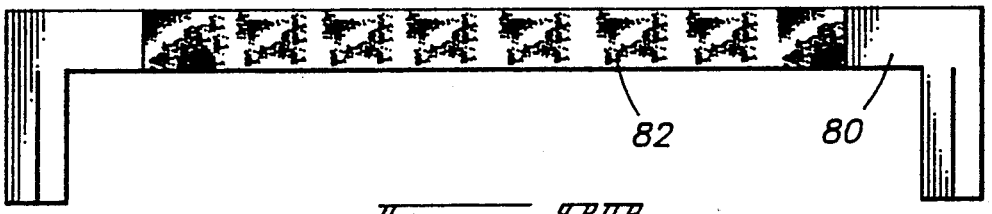

The ribbon guide carrier 70 shown in FIG. 8A has three attachment regions 78*a*, 78*b*, and 78*c*. The number of regions may, of course, be one, two, three, four or more. For example, a second embodiment of a ribbon guide carrier 80 may have one continuous attachment region 82 spread across the length of the body as shown in FIG. 8B. In this second embodiment, all of the ribbon guides 62*a*, 62*b*, and 62*c* are supported by the single attachment region 82.

Figure 9:
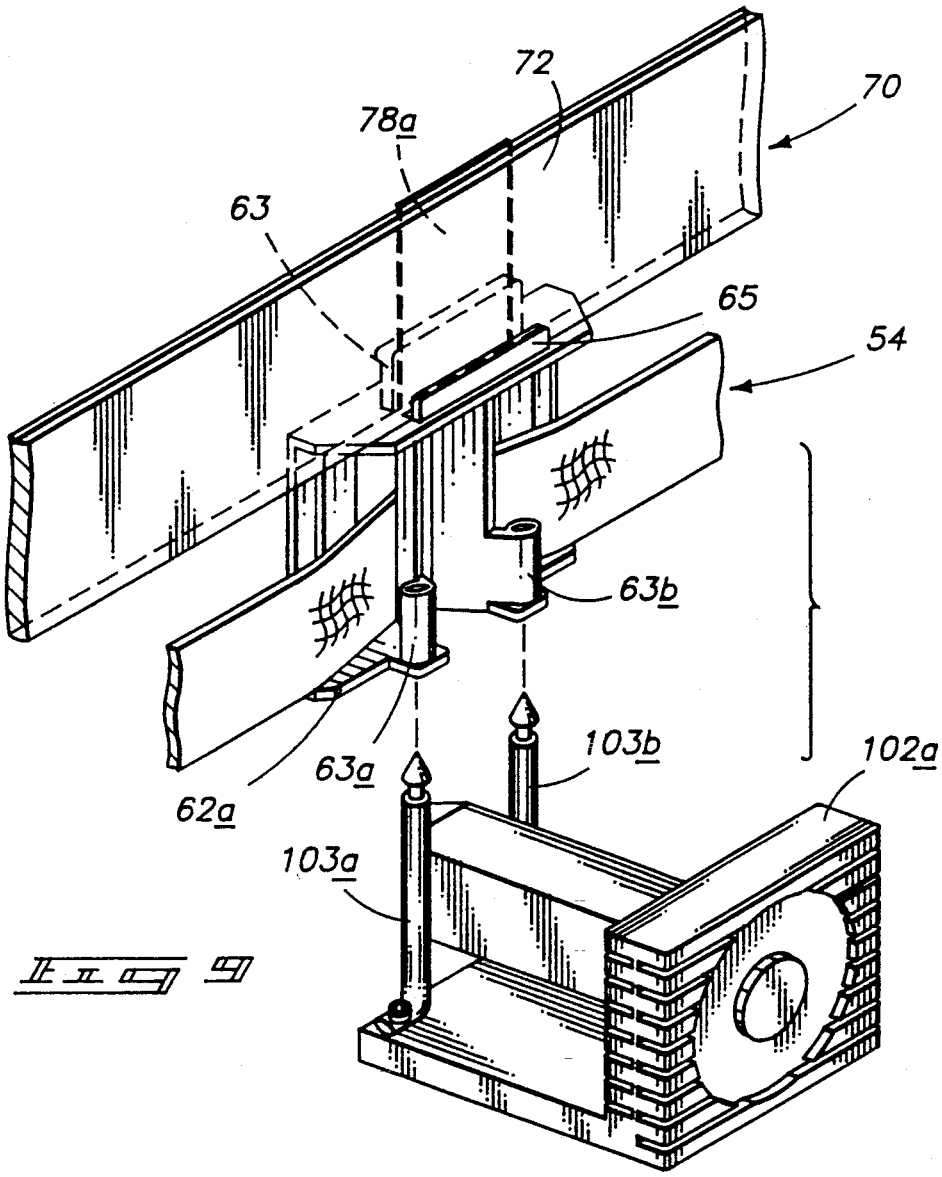
FIG. 9 illustrates the mounting of one of the ribbon guides onto one of the print heads using the ribbon guide carrier.

FIG. 9 illustrates how each ribbon guide is connected to the ribbon guide carrier. As shown in FIG. 9, the attachment region 78*a* (shown in phantom) of the body 72 is inserted between a primary lip 63 (also shown in phantom) and a secondary lip 65 of the ribbon guide 62*a*. The attachment region 78*a* is releasably connected to the primary lip 63 via an adhesive bond. With reference to FIG. 4, the ribbon guide carrier 70 supports and aligns the ribbon guides 62*a*, 62*b*, and 62*c* because the attachment regions 78*a*, 78*b*, and 78*c* on the body 72 are connected to the respective primary lips (not shown) on the ribbon guides 62*a*, 62*b*, and 62*c*. Although the preferred embodiment is described as having the attachment regions 78*a*, 78*b* and 78*c* on only one side of the body 72, the present invention contemplates placing attachment regions on both sides of the body 72.

As shown in FIGS. 4 and 8A, the body 72 of the ribbon guide carrier 70 is planar and extends in first direction from a first end to a second end. The two sets of members 74*a*, 74*b* and 76*a*, 76*b* extend in a second direction, which is substantially perpendicular to the first direction, from the opposing ends of the body 72. Members 74*a* and 74*b* are adjacently aligned and define a slot 75 which has sufficient dimensions to permit passage of the print ribbon 54 (as shown in FIG. 4). Similarly, members 76*a* and 76*b* are adjacently aligned and define a slot 77 which has sufficient dimensions to permit passage of the print ribbon 54. The two sets of members 74*a*, 74*b* and 76*a*, 76*b* assist in keeping the print ribbon 54 taught to facilitate installation. The ribbon guide carrier 70 has been described as having two members on each end of the body 72; but, three or more members may be employed on each end of the body 72, whereby the print ribbon 54 is woven through the multiple members.

The installation of the printer ribbon cartridge 50 according to the present invention will now be described with reference to FIGS. 5–7 and 9. The installation is described with reference to a dot matrix printer 100 having three print heads 102*a*, 102*b*, and 102*c* positioned at preset spaced distances on a reciprocating print head carriage.

Figure 5:
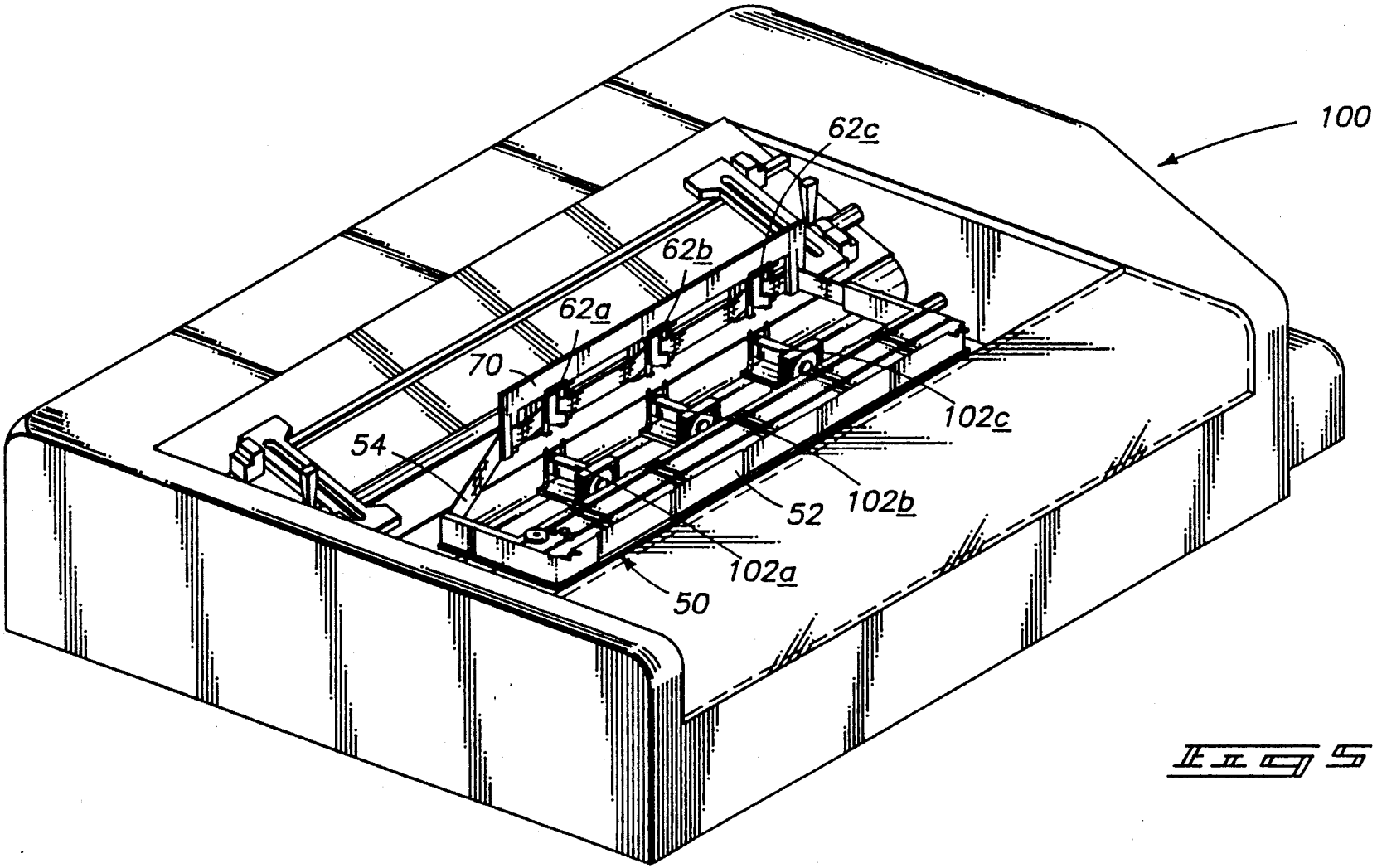

To install the printer ribbon cartridge 50, the cartridge housing 52 is first mounted on the print head carriage as shown in FIG. 5. At this time, the exposed print section of the print ribbon 54 has some slack, thereby allowing the user to lift the ribbon guide carrier 70 (and thus, the three ribbon guides 62*a*, 62*b*, and 62*c*) above the print heads 102*a*, 102*b*, and 102*c*. Notice that the ribbon guides 62*a*, 62*b*, and 62*c* are connected to the ribbon guide carrier 70 at prescribed spaced distances corresponding to the preset spaced distances of the print heads 102*a*, 102*b*, and 102*c*. The ribbon guide carrier 70 maintains the ribbon guides 62*a*, 62*b*, and 62*c* in a single plane to maintain the ribbon guides in alignment. The ribbon guide carrier 70 serves as a handle and mounting fixture to mount the three ribbon guides 62*a*, 62*b*, and 62*c* in a single downward stroke.

Figure 6:
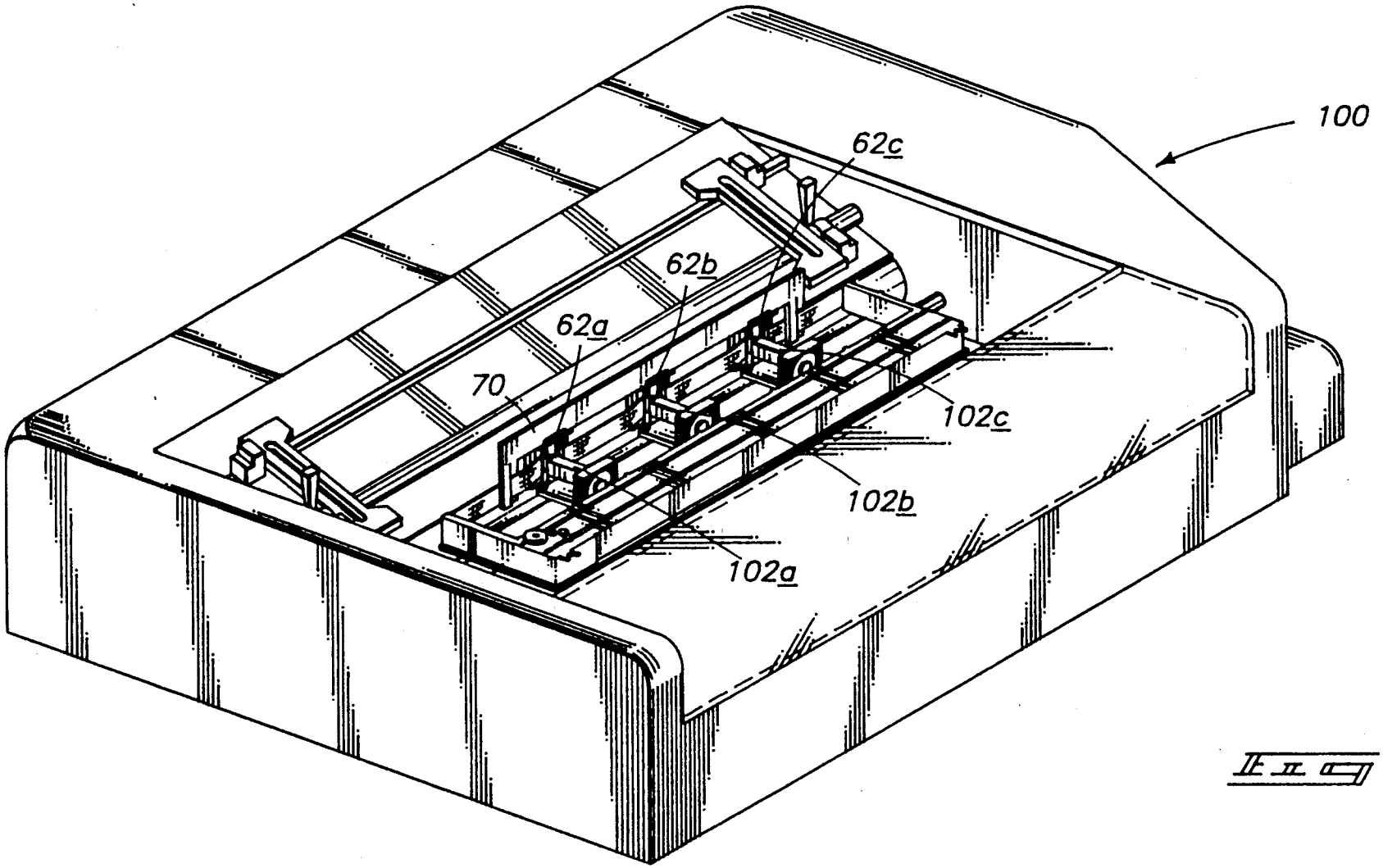
Figure 11:
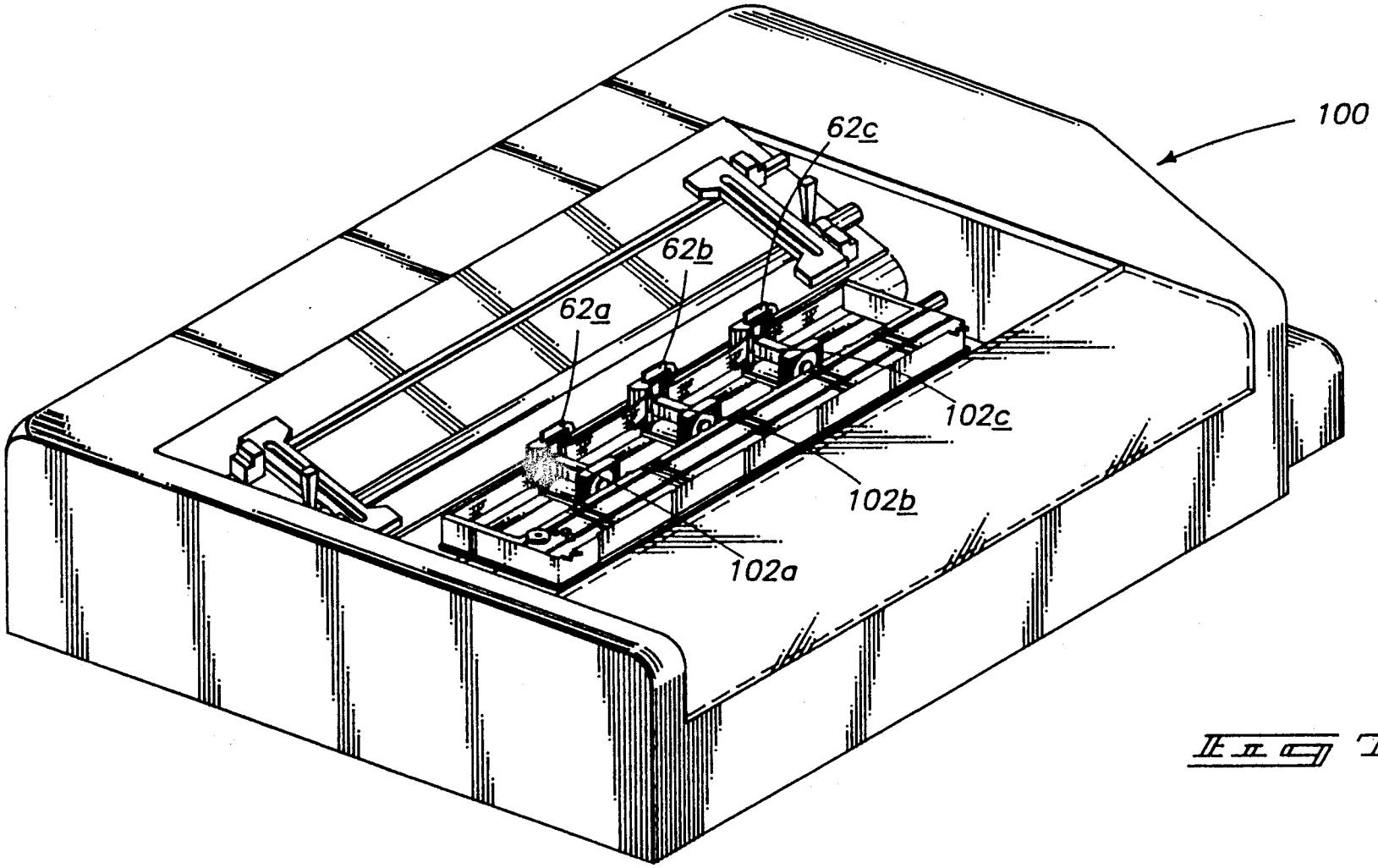

As shown in FIG. 6, the user then mounts the three ribbon guides 62*a*, 62*b*, and 62*c* onto respective print heads 102*a*, 102*b*, and 102*c*. FIG. 9 illustrates the mounting of one ribbon guide onto one print head in more detail. The ribbon guide 62*a* has two collars 63*a* and 63*b* which are directed onto two alignment pins 103*a* and 103*b* of the print head 102*a*. The pins 103*a* and 103*b* slide through the collars 63*a* and 63*b* and fasten into a slot provided on the ribbon guide 62*a*. Once in place, the ribbon guide 62*a* guides the print ribbon 54 over the printing elements of the print head 102*a*.

In one embodiment of the present invention, the ribbon guides 62*a*, 62*b*, and 62*c* are horizontally aligned on the ribbon guide carrier 70 such that the ribbon guides 62*a*, 62*b*, and 62*c* are simultaneously mounted onto respective print heads 102*a*, 102*b*, and 102*c*. In an alternative embodiment, however, the ribbon guides 62*a*, 62*b*, and 62*c* may be staggered vertically, with respect to one another, on the ribbon guide carrier 70 such that the ribbon guides 62*a*, 62*b*, and 62*c* are sequentially mounted onto the print heads 102*a*, 102*b*, and 102*c*. For example, the collars of ribbon guide 62*a* are first slid onto the pegs of the print head 102*a*, then the collars of the ribbon guide 62*b* are slid onto the pegs of the print head 102*b*, and finally the collars of the ribbon guide 62*c* are slid onto the pegs of the print head 102*c*. Vertically staggering the ribbon guides 62*a*, 62*b*, and 62*c* may help facilitate installation.

After all three ribbon guides 62*a*, 62*b*, and 62*c* are mounted, the user releases the ribbon guides 62*a*, 62*b*, and 62*c* from the ribbon guide carrier 70, and removes the ribbon guide carrier 70, as shown in FIG. 7. As a last step, the user tightens the print ribbon 54 to take up any undesired slack.

The preferred embodiment of the present invention has been described as employing a releasable ribbon guide carrier. In another embodiment, the ribbon guide carrier may remain attached to the ribbon guides, and not removed after the guides are mounted on the print heads. For example, the ribbon guide carrier may be permanently attached to the ribbon guides in such a manner which permits the ribbon guide to be moved to a non-interfering position after installation.

The present invention, as described above, has at least two significant advantages. First, the present invention facilitates easy installation because the user may simultaneously mount all three ribbon guides onto the respective print heads. The ribbon guide carrier prevents the ribbon guides from independently twisting around, and sliding along, the exposed print section of the print ribbon during storage and handling. The ribbon guide carrier guides the ribbon guides onto the print heads in an efficient and effective manner. Second, the installation involves less mess because the user only handles the ribbon guide carrier, rather than the individual ribbon guides, whereby the user may avoid touching the ink soaked ribbon.

In compliance with the statute, the invention has been described in language more or less specific as to structural features. The invention is not, however, limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

We claim:

1. A computer printer ribbon cartridge for a multihead printer, the printer having a plurality of print heads positioned at preset spaced distances on a reciprocating print head carriage, the printer ribbon cartridge comprising:

a cartridge housing for mounting on the print head carriage;

a print ribbon mounted in the cartridge housing, the print ribbon having an exposed print section for extending in front of the plurality of print heads;

a plurality of ribbon guides slidably coupled on the exposed print section of the print ribbon; and a ribbon guide carrier operatively connected to the ribbon guides for supporting the ribbon guides on the exposed print section of the print ribbon at prescribed distances relating to the preset spaced distances of the plurality of print heads on the print head carriage.

2. The computer printer ribbon cartridge as defined in claim 1 wherein the ribbon guide carrier has a body and releasable supporting means on the body for supporting the ribbon guides as the printer ribbon cartridge is being mounted on the print head carriage and for releasing the ribbon guides once the ribbon guides are in place on the print head carriage.

3. A ribbon guide carrier as defined in claim 2 wherein the releasable supporting means comprises a plurality of support regions spaced at the prescribed distances corresponding to the preset spaced distances of the plurality of print heads, each of the plurality of support regions releasably supporting a corresponding one of the plurality of ribbon guides.

4. A ribbon guide carrier as defined in claim 3 wherein the support regions are equally spaced.

5. A ribbon guide carrier as defined in claim 2 wherein the releasable supporting means comprises one continuous support region across a length of the body, the one continuous support region releasably supporting all of the plurality of ribbon guides.

6. A ribbon guide carrier as defined in claim 2 wherein the releasable supporting means comprises a plurality of adhesive regions spaced at the prescribed distances corresponding to the preset spaced distances of the plurality of print heads, each of the plurality of adhesive regions releasably supporting a corresponding one of the plurality of ribbon guides.

7. A ribbon guide carrier as defined in claim 6 wherein the adhesive regions are formed of glue.

8. A ribbon guide carrier as defined in claim 6 wherein the adhesive regions are formed of double-sided tape.

9. A ribbon guide carrier as defined in claim 2 wherein the releasable supporting means comprises one continuous adhesive region across a length of the body, the one continuous adhesive region releasably supporting all of the plurality of ribbon guides.

10. A ribbon guide carrier as defined in claim 9 wherein the adhesive region is formed of glue.

11. A ribbon guide carrier as defined in claim 9 wherein the adhesive region is formed of double-sided tape.

12. A ribbon guide carrier as defined in claim 2 wherein the body of the ribbon guide carrier extends in a first direction from a first end to a second end, the ribbon guide carrier further comprising:

at least two first members extending from the first end of the body in a second direction substantially perpendicular to the first direction, the first members being adjacently aligned to define a first slot, the first slot having dimensions which receive the print ribbon; and at least two second members extending from the second end of the body in the second direction, the second members being adjacently aligned to define a second slot, the second slot having dimensions which receive the print ribbon.

13. A ribbon guide carrier for a computer printer ribbon cartridge used in a multi-head printer, the printer ribbon cartridge having a plurality of ribbon guides slidably coupled on an exposed print section of a print ribbon, the printer having a plurality of print heads positioned at preset spaced distances, the ribbon guide carrier comprising:

a body extending in a first direction from a first end to a second end;

releasable supporting means, positioned on the body between the first and second ends, for supporting the ribbon guides as the ribbon guides are mounted on corresponding ones of the print heads and for releasing the ribbon guides once the ribbon guides are in place; and ribbon support means adjacent the first and second ends for receiving and releasably supporting the print ribbon.

14. A ribbon guide carrier as defined in claim 13 wherein the releasable supporting means supports the ribbon guides at prescribed distances corresponding to the preset spaced distances of the plurality of print heads.

15. A ribbon guide carrier as defined in claim 13 wherein the releasable supporting means comprises a plurality of support regions spaced at prescribed distances corresponding to the preset spaced distances of the plurality of print heads, each of the plurality of support regions releasably supporting a corresponding one of the plurality of ribbon guides.

16. A ribbon guide carrier as defined in claim 15 wherein the support regions are equally spaced.

17. A ribbon guide carrier as defined in claim 13 wherein the releasable supporting means comprises one continuous support region across a length of the body between the first and second ends, the one continuous support region releasably supporting all of the plurality of ribbon guides.

18. A ribbon guide carrier as defined in claim 13 wherein the releasable supporting means comprises a plurality of adhesive regions spaced at prescribed distances corresponding to the preset spaced distances of the plurality of print heads, each of the plurality of adhesive regions releasably supporting a corresponding one of the plurality of ribbon guides.

19. A ribbon guide carrier as defined in claim 18 wherein the adhesive regions are formed of glue.

20. A ribbon guide carrier as defined in claim 18 wherein the adhesive regions are formed of double-sided tape.

21. A ribbon guide carrier as defined in claim 13 wherein the releasable supporting means comprises one continuous adhesive region across a length of the body between the first and second ends, the one continuous adhesive region releasably supporting all of the plurality of ribbon guides.

22. A ribbon guide carrier as defined in claim 21 wherein the adhesive region is formed of glue.

23. A ribbon guide carrier as defined in claim 21 wherein the adhesive region is formed of double-sided tape.

* * * * *